United States Patent [19]

Wilson et al.

[11] Patent Number: 4,906,126

[45] Date of Patent: Mar. 6, 1990

[54] RESURFACING APPARATUS AND PROCESS

[75] Inventors: Jack H. Wilson, Jackson; Willis G. Dykes, Vicksburg, both of Miss.

[73] Assignee: Sport Koter USA, Inc., Jackson, Miss.

[21] Appl. No.: 309,963

[22] Filed: Feb. 13, 1989

Related U.S. Application Data

[63] Continuation of Ser. No. 117,495, Nov. 6, 1987, abandoned, which is a continuation-in-part of Ser. No. 10,936, Feb. 5, 1987, Pat. No. 4,789,265.

[51] Int. Cl.[4] ..... E01C 19/16

[52] U.S. Cl. ..... 404/75; 404/96; 404/101; 427/136; 118/108

[58] Field of Search ..... 404/72, 75, 96, 97, 404/101, 111, 118; 118/108, 207; 427/136–138, 272; 156/247; 15/49 R, 93 R, 98, 114, 117

[56] References Cited

U.S. PATENT DOCUMENTS

| | | | |
|---|---|---|---|
| 1,142,698 | 6/1915 | Grove et al. | 15/117 |
| 1,760,442 | 5/1930 | Robb | 404/83 |
| 1,914,950 | 6/1933 | Kanen | 404/111 |
| 1,994,437 | 3/1935 | Reis | 404/96 |
| 2,175,511 | 10/1939 | Wahlstrom et al. | 404/111 |
| 2,182,217 | 12/1939 | Wahlstrom et al. | 404/101 |
| 2,741,788 | 4/1956 | Shey | 15/117 X |
| 3,052,167 | 9/1962 | Beale | 404/85 |
| 3,153,992 | 10/1964 | Dabelle | 404/111 |
| 3,174,413 | 3/1965 | Wittmack, Jr. | 404/118 |
| 3,220,321 | 11/1965 | Lewis | 404/96 |
| 3,283,675 | 11/1966 | Gifford et al. | 404/111 |
| 3,703,856 | 11/1972 | Wikel et al. | 404/111 |
| 3,841,779 | 10/1974 | Ray | 404/111 |
| 3,989,403 | 11/1967 | Verive | 404/111 |
| 4,037,289 | 7/1977 | Dojan | 15/320 |
| 4,379,187 | 4/1983 | Seman | 156/247 X |
| 4,465,397 | 8/1984 | Hollon et al. | 404/84 |
| 4,477,203 | 10/1984 | Laditka | 404/111 |
| 4,532,882 | 8/1985 | Ciraud | 118/108 |
| 4,621,944 | 11/1986 | Jordense | 404/96 |
| 4,678,365 | 7/1987 | Ban et al. | 404/118 |
| 4,747,174 | 5/1988 | Hightower | 15/49 R X |
| 4,752,154 | 6/1988 | Valentine | 404/72 |
| 4,789,265 | 12/1988 | Wilson et al. | 404/75 |
| 4,793,731 | 12/1988 | Gnesa | 404/111 |

FOREIGN PATENT DOCUMENTS

| | | |
|---|---|---|
| 2534387 | 2/1977 | Fed. Rep. of Germany . |
| 2546928 | 3/1983 | France . |
| 217090 | 6/1924 | United Kingdom . |

*Primary Examiner*—Jerome W. Massie
*Assistant Examiner*—Matthew Smith
*Attorney, Agent, or Firm*—Nixon & Vanderhye

[57] ABSTRACT

Method and apparatus are provided for resurfacing recreational (e.g., tennis) courts and other surfaces. The apparatus includes self-contained drive system including drive wheels mounted on an elongated frame structure, and additionally supported for rolling movement on a plurality of casters. The apparatus is provided with flexible blade and brush elements for spreading and smoothing court resurfacing material uniformly across the surface. In a forward resurfacing direction, flexible squeegee-type blades, with or without associated brushes, engage the resurfacing material ahead of the device, while flexible brush elements engage the resurfacing material behind the device to erase tracks caused by the drive wheels and casters, and to effect final smoothing and texturing of the resurfacing material. The drive wheels may be moved into and out of ground engaging contact, and a steering device provides for lifting one or the other of the drive wheels out of ground engaging contact. The device is movable in one direction to resurface an entire tennis court in a single pass. In a related aspect, tape is applied over the court boundary lines prior to resurfacing, and removed after resurfacing. Multiple coats of resurfacing material may be applied, in the same, or different directions.

31 Claims, 10 Drawing Sheets

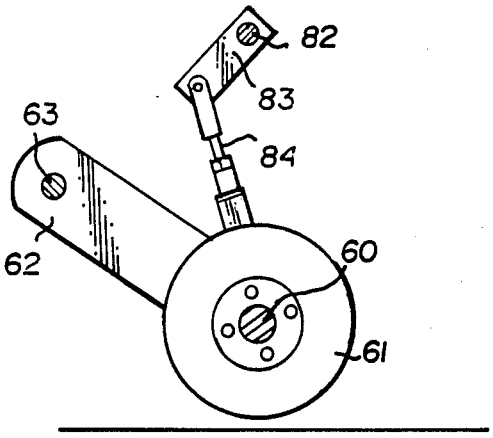
FIG. 8
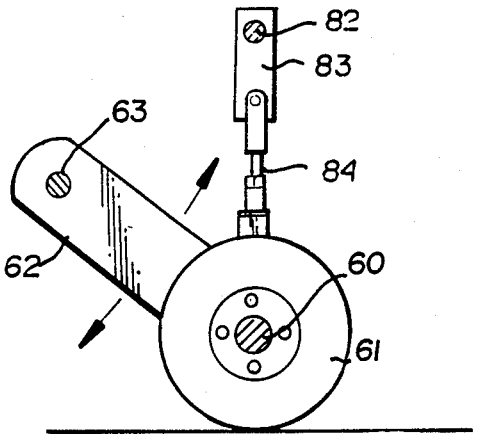
FIG. 7
FIG. 9
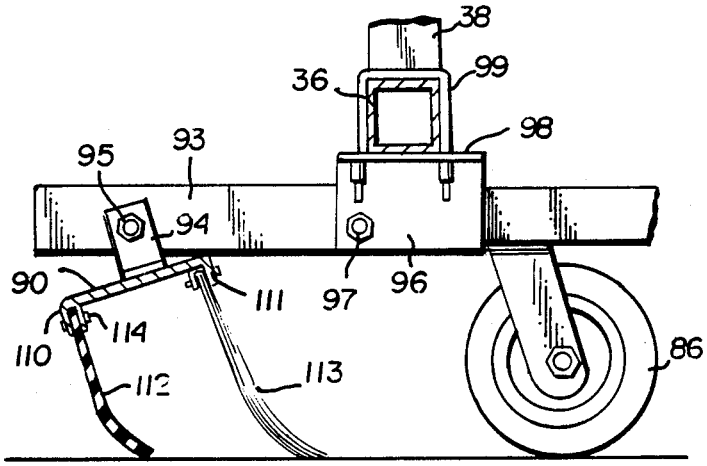
FIG. 10
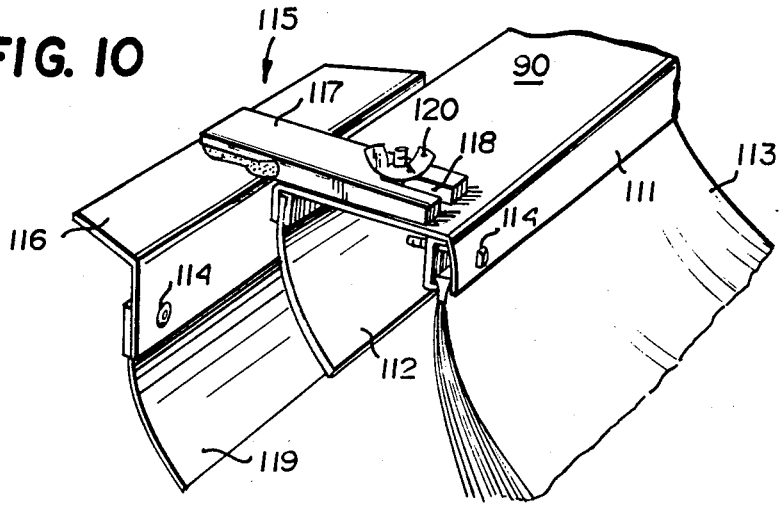

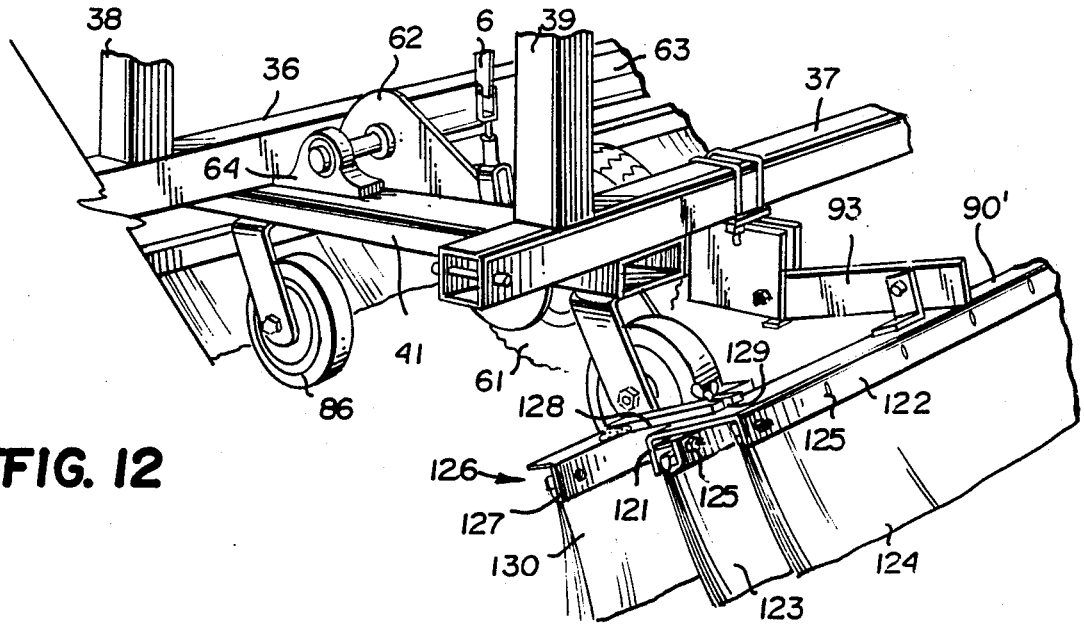
FIG. 12
FIG. 11
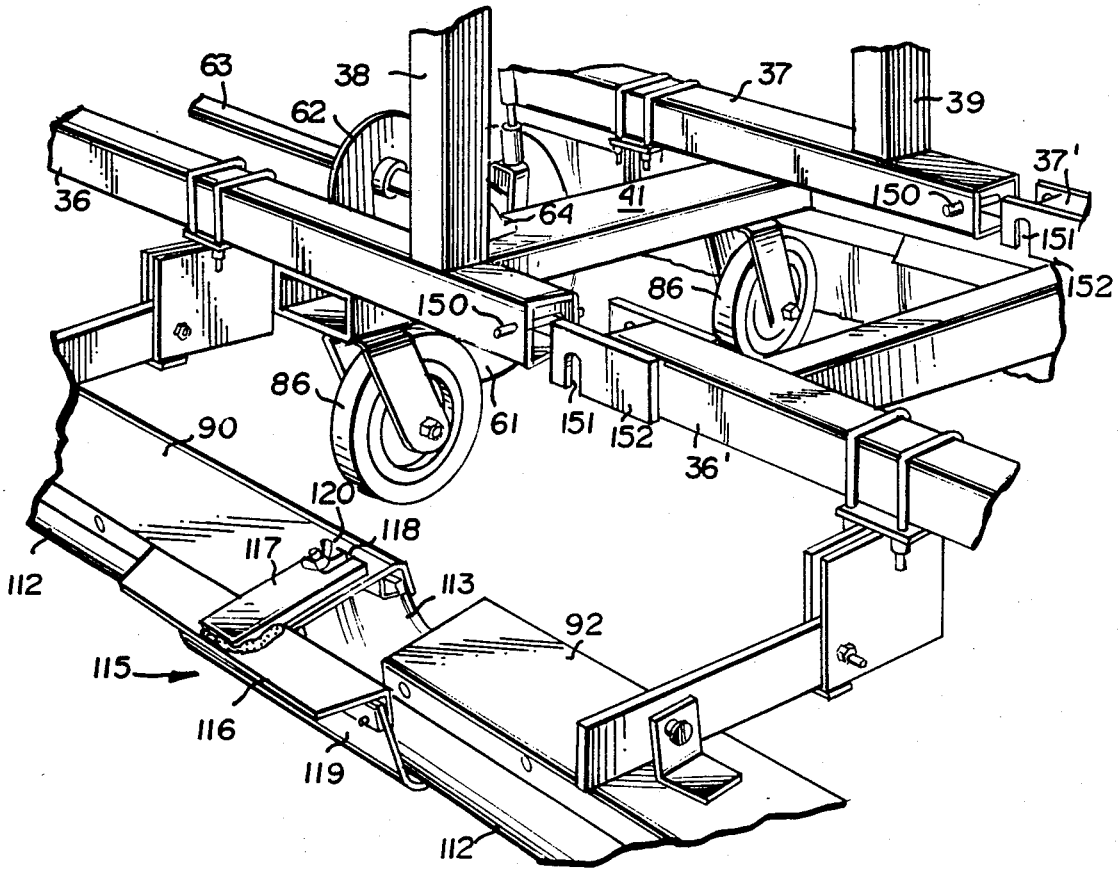

FIG. 13
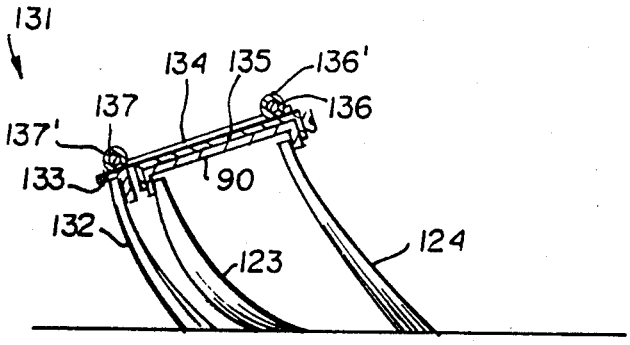
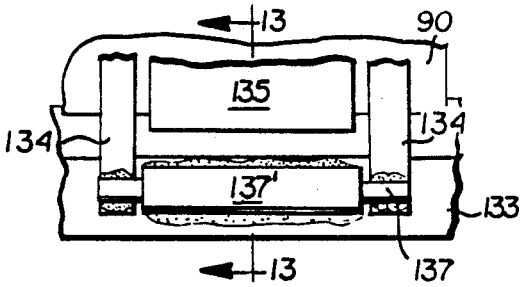
FIG. 13a
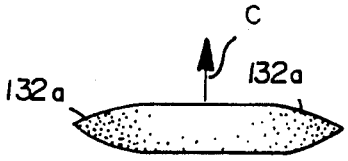
FIG. 13b
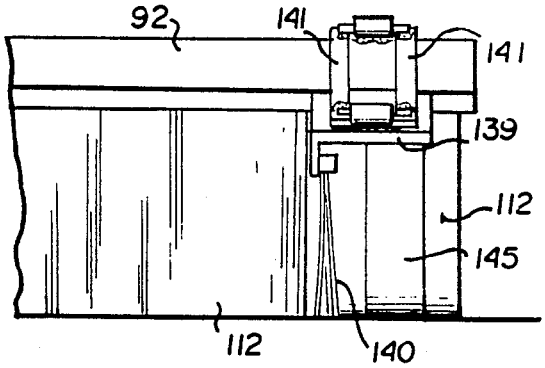
FIG. 14
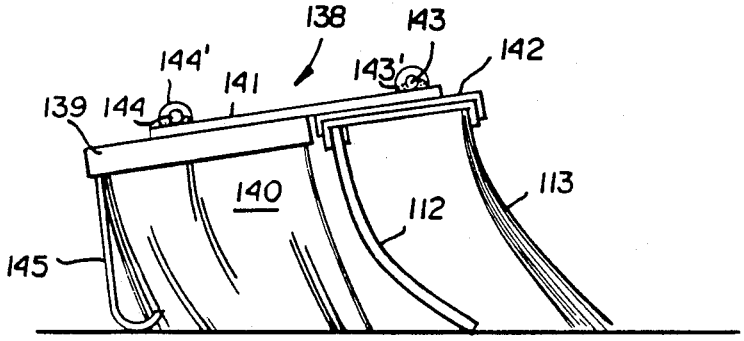
FIG. 15

RESURFACING APPARATUS AND PROCESS

RELATED APPLICATION

This application is continuation of Ser. No. 117,495 filed Nov. 6, 1987, now abandoned which is a continuation-in-part of Ser. No. 10,936 filed Feb 5, 1987 now U.S. Pat. No. 4,789,265 issued Dec. 6, 1988.

BACKGROUND AND SUMMARY OF THE INVENTION

This invention relates primarily to the repair and maintenance of surfaces such as indoor or outdoor, hard recreational surfaces and, particularly, to the resurfacing of tennis courts, basketball courts and the like. In the past, acrylic resurfacing material typically employed for tennis courts has been applied manually and thereafter spread about by a number of individuals working with hand-held, squeegee-like spreaders, typically 30" in width. The resulting surface coating often varies in thickness and exhibits unsightly streaks resulting from the uneven application and multi-directional spreading techniques common in the prior art. The surface coating can range from thin to thick and, as a result, often shows noticeable deterioration even within one year after resurfacing.

The prior art method is also labor intensive, time consuming and therefore very costly. More importantly, quality result is not assured.

According to this invention, an improved apparatus and a process for resurfacing relatively hard and flat surfaces such as, but not limited to, recreational surfaces such as tennis courts, are presented herein which have several advantages over the prior art.

The present invention relates to a mobile, self-propelled device which can spread and smooth resurfacing material uniformly over an entire court surface in a single pass. This, of course, represents a fraction of the time required by conventional manual application techniques.

The present invention not only permits significantly more rapid resurfacing, but also provides a far superior uniformity of thickness throughout the resurfaced area.

In our earlier filed application, a resurfacing apparatus and process are disclosed which offer many advantages over conventional court resurfacing techniques. This invention constitutes an improvement over the earlier apparatus and process.

According to one exemplary embodiment of the invention, an elongated frame, preferably constructed in three separable but substantially axially aligned sections, is supported on a plurality of freely rotatable casters. The total width of the three-section frame may be varied as desired, but preferably exceeds the width of a regulation size tennis court. Other sizes may be achieved by shortening or lengthening any or all of the frame sections, and/or by removing altogether the separable side sections, depending on the size of the surface to be refinished. In the preferred embodiment, the center frame section approximately 20 feet wide, and each side or wing section is approximately 19 feet wide.

An internal combustion engine is utilized to drive the device. The engine is preferably mounted on the center section of the frame along with a centrifugal clutch, a forward-neutral-reverse transmission, and a roller drive train to a live drive axle mounting a pair of drive wheels. The ends of the live drive axle are supported for pivotal movement between an operative positive ground-engaging position, a neutral position, and an inoperative position in which both drive wheels are raised above the ground. To this end, a unique torsional shaft arrangement allows about 80% of the weight of the center section of the frame to be directed onto the drive wheels for increased traction in the operating position. Rotation of the torsional shaft to raise or lower the drive wheels is accomplished by a hand crank manually actuated by the machine operator.

The resurfacing apparatus of this invention may also be steered by actuating one or the other of two upstanding levers, located on either side of a driver's seat mounted substantially in the middle of the center section. Each lever is operatively connected to a respective drive wheel. By rotating, for example, the right lever, the right drive wheel is lifted clear of the ground, thereby losing its traction. The left drive wheel, however, maintains its positive ground engagement and produces full traction so as to pull the left end of the unit ahead of the right end. Thus, actuating the right or left steering lever produces a braking action on the right or left end, respectively, of the unit, thereby permitting the unit to be steered as desired. The above described torsional shaft also permits the steering levers to act independently of one another, and without negative impact on the mechanism employed to raise and lower the drive wheels between operative and inoperative positions.

It should be understood, however, that once the device is accurately aligned, motor started and drive wheels engaged, the operator need not remain seated on the device, but may walk along side it as it moves across the surface. Only if it becomes apparent that the device is beginning to move off course does the operator need to mount the unit and redirect the unit via the steering mechanism.

The two side frame sections which are substantially identical, are releasably attached to the center frame section for ease of transport and/or storage. The side sections are passive in the sense that they contain no portion of the drive train or steering systems of the unit.

Extending along front and rear faces of the unit are a plurality of channel members, each of which includes web and flange portions. Three such channel members are pivotally mounted to the three respective frame sections along both the front and rear faces of the unit. Thus, in one exemplary embodiment, a total of six such channel members are employed. The channel members along the front and rear of the machine, respectively, are in substantial axial alignment, and at the same time, are mounted substantially independently of each other such that all of the channel members are free to float relative to the frame sections to which they are attached.

Front and rear flanges of the channel members extending across the front face of the unit support leading squeegee-type blades and a trailing bristle brushes, respectively. Along the rear face of the machine, aligned channel members each mount leading and trailing bristle brushes.

As used herein, the term "leading" indicates that the so-described component contacts the resurfacing material ahead of the "trailing" component. Further, the channels which extend along the front of the machine, and their associated squeegee-type blades and brushes, will be referred to as the "lead" or "leading" applicator, while the channel members which extend across the rear face of the unit, and their respective bristle brushes will be referred to as the "rear" or "trailing" applicator.

The above described arrangement is such that the leading squeegee-type blade of the lead applicator contacts the resurfacing material first, and pushes the majority of the material ahead of the machine, but allowing a limited quantity to flow underneath the blade. The trailing bristle brush of the lead applicator serves to further thin out and smooth the resurfacing material.

The leading and trailing brushes of the trailing applicator serve to even further spread and thin out the resurfacing material and, significantly, they function to eliminate tracks formed in the wetted surface by the drive wheels and casters, and create a finished texture in the acrylic material.

It is a further feature of this invention to provide squeegee-type blades which serve to cover gaps which are present between adjacent channel sections of the leading applicator. In a like manner, additional brushes are provided along the lead brush of the rear applicator to cover similar gaps.

It is a further feature of the invention to provide end brushes which extend substantially perpendicularly forward of the squeegee-type blades of the lead applicator so as to confine the resurfacing material within well defined boundaries, i.e., in the direction of travel of the unit. This is particularly advantageous for two-tone tennis court refinishing operations where the "in-bound" color differs from the "out of bounds" color.

With regard to both the lead applicator and rear applicator, it is a further feature of the invention that each of the channel members may be rotated upwardly away from the ground, and latched in an inoperative position to further facilitate transport and/or storage of the device.

It is still another feature of this invention to provide at least one transport dolly, for facilitating transport of a frame center section, when separated from at least one of the frame side sections.

In another aspect, this invention relates to an improved process for resurfacing a tennis court or other recreational court surface which is marked by boundaries, typically in the form of painted lines. In the past, after an asphalt or "black-top" court has been resurfaced, it has been necessary to re-paint the boundaries which, of course, resulted in additional time and expense to complete the process. In accordance with this invention, a relatively simple process is provided which overcomes the disadvantages of conventional techniques. In the exemplary embodiment, the process of this invention may be carried out as follows:

(a) covering existing court boundaries with strips of material, preferably adhesive-type tape which will not remove the paint when it is pulled up after the resurfacing operation;

(b) positioning a resurfacing device as described above adjacent, but outside the boundaries of the court, and preferably parallel to one of the end line, or width boundaries;

(c) applying resurfacing material, preferably a sand-filled acrylic material of predetermined viscosity, in front of the device, preferably along its entire width;

(d) moving the device forwardly along at least and preferably beyond the entire length and width of the court, spreading out and smoothing the resurfacing material by the leading and trailing applicators; and (e) removing the strips of tape to expose the original boundary lines.

In the event the original boundary lines are in need of re-painting, it is preferable that the re-painting be done first, followed by steps (a) through (e).

It will be appreciated that, in an alternative procedure, the machine may be positioned to travel in a direction transverse to the court length. This is particularly advantageous when resurfacing a number of adjacent courts, since all of the courts may be completely resurfaced in two passes of the machine. In other words, in one pass, one half of all of the courts (and areas adjacent the end lines on one side) may be resurfaced as the machine travels in one direction, and the other half of all of the courts (and areas adjacent the end lines on the other side) may be resurfaced as the machine returns in an opposite direction.

In addition, more than one coat may be applied as desired. In applying two coats, for example, a particularly attractive texture may be created by applying the second coat in a direction substantially perpendicular to the first. This procedure creates a striking "linen-like" texture to the court, created by the brushes on the trailing applicator.

Additional objects and advantages of the invention will become apparent upon reading the detailed description of the invention in conjunction with the accompanying drawings.

BRIEF DESCRIPTION OF THE DRAWINGS

FIGS. 7 and 8 are enlarged details illustrating the manner in which the drive wheels of the apparatus according to this invention may be raised or lowered between operative and inoperative positions;

FIG. 9 is a partial cross-sectional side view illustrating a squeegee-type blade and brush mounted in accordance with the present invention;

FIG. 10 is a partial perspective view illustrating a squeegee-type blade gap seal device in accordance with the invention;

FIG. 11 is a partial perspective view illustrating the manner in which a blade gap seal device according to the invention overlaps the squeegee-type blades provided on the center and side sections of a leading applicator portion of the apparatus;

FIG. 12 is a partial perspective view illustrating a brush gap seal device in accordance with the invention provided on the center section of a trailing applicator portion of the apparatus;

FIG. 13 is a partial cross-sectional view of an another brush gap seal device in accordance with an alternative embodiment of the invention taken along the line 13—13 of FIG. 13*a;*

FIG. 13*a* is a partial top view of the brush gap seal device illustrated in FIG. 13;

FIG. 13*b* is a bottom view of the brush portion of the brush gap seal devices of FIGS. 12 and 13;

FIG. 14 is a partial front view illustrating an end brush in accordance with the present invention;

FIG. 15 is a side view of the end brush illustrated in FIG. 14;

DETAILED DESCRIPTION OF THE DRAWINGS

Figure 1:
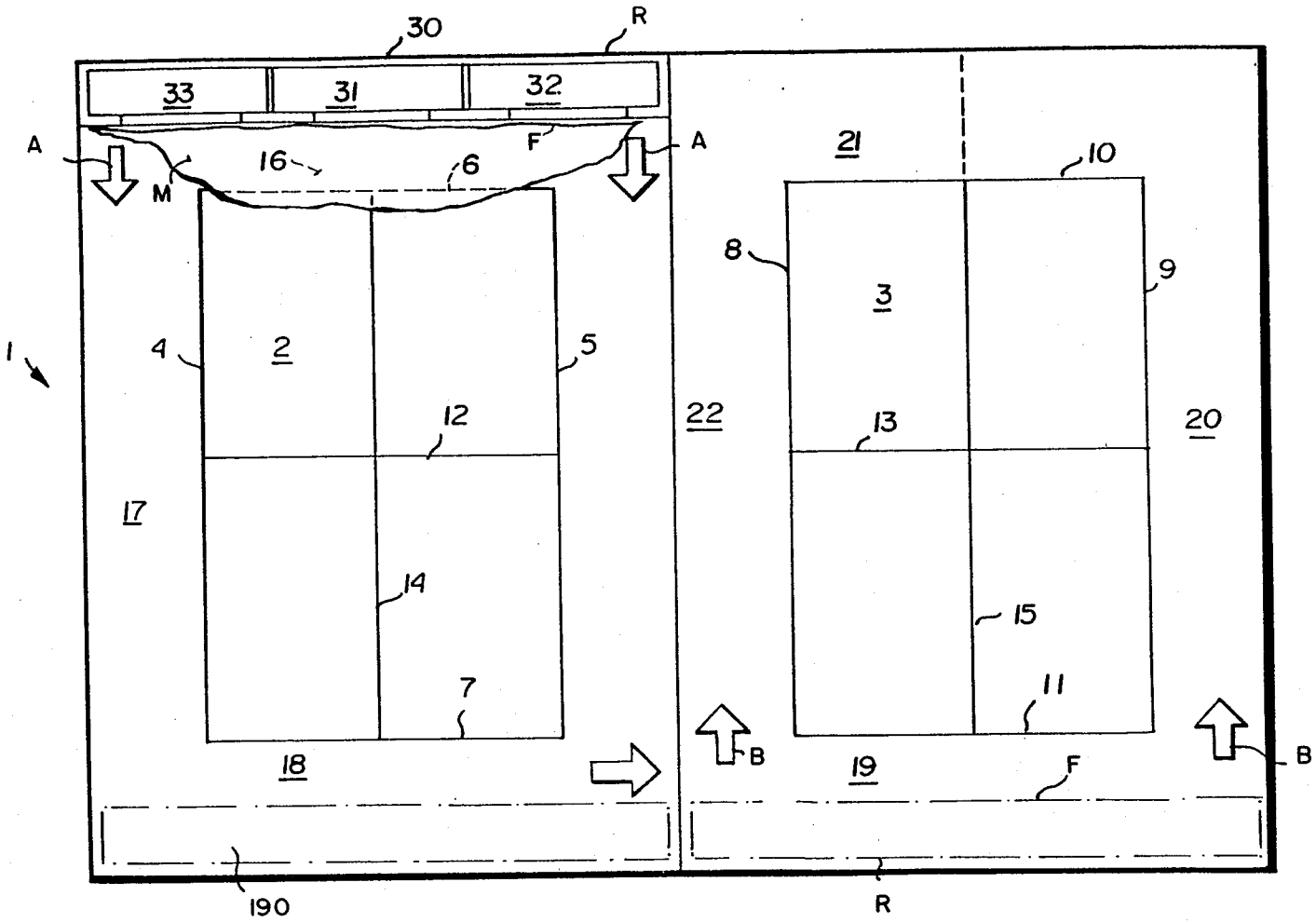
FIG. 1 is a schematic view of resurfacing machine in accordance with this invention, positioned for a resurfacing operation on a pair of adjacent tennis courts.

Referring now to FIG. 1, a typical multiple court configuration 1 includes a pair of side-by-side tennis courts 2, 3. Court 2 is defined by lengthwise boundary lines 4, 5 and widthwise boundary lines 6, 7. Similarly, court 3 is defined by lengthwise boundary lines 8, 9 and widthwise boundary lines 10, 11.

Typically, tennis courts are divided in half by lines 12, 13 which coincide with the location of nets (not shown). Court 2 is divided longitudinally by line 14 to define service areas while court 3 is similarly divided by line 15. In the context of this invention, lines 4, 5, 8 and 9 are considered the outer boundary lines typically employed in doubles matches. In other words, for alignment purposes, it is the outermost court boundaries that are significant, and other, interior lines, such as singles match boundaries and service lines are not shown.

It will be appreciated that surrounding surfaces such as those indicated by reference numerals 16, 17, 18, 19, 20, 21, as well as the surface 22 between the two courts, typically have the same composition as the courts themselves, and are therefore subject to the same maintenance and repair requirements. Thus, any resurfacing operation would normally include all surfaces in surrounding relationship to the courts proper.

FIG. 1 also illustrates, generally, a resurfacing machine 30 positioned in surface area 16 outside the boundaries of court 2, and in generally parallel alignment with the widthwise boundary line 6.

The manner is which the apparatus or machine 30 is utilized to resurface such a court will be explained in detail further hereinbelow. It will be understood, of course, that the present invention may be used with similar advantages in the resurfacing or refinishing of any number of hard recreational court surfaces, as well as other relatively flat surfaces in relatively well defined areas such as parking lots, air strips, roadways and the like.

Figure 2:
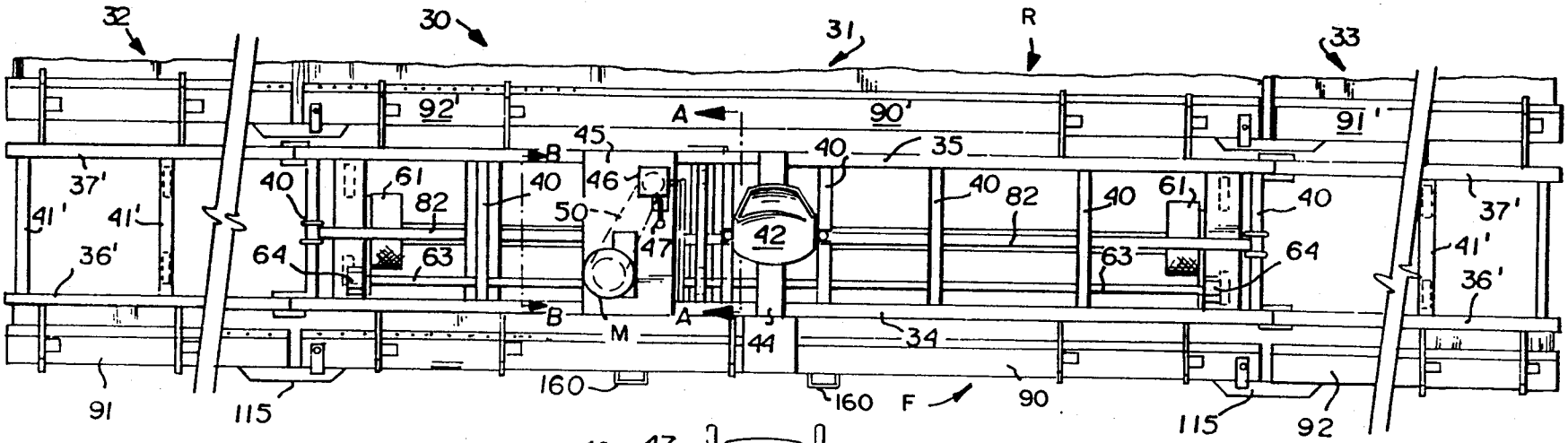
FIG. 2 is a partial top view of a resurfacing apparatus in accordance with this invention.
Figure 3:
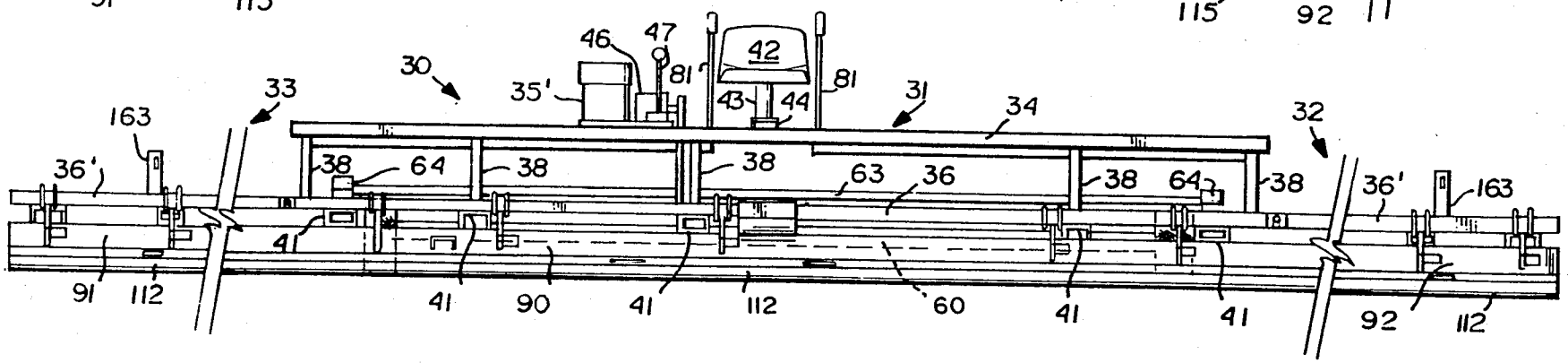
FIG. 3 is a partial front view of the resurfacing apparatus illustrated in FIG. 2.

Referring now to FIGS. 1-3, the overall structure and drive arrangement for the resurfacing device will be described in considerable detail. The device 30 comprises, essentially, an elongated structural frame including a center section 31 and separable left and right side sections 32, 33, respectively.

The center section is constructed in the form of a substantially rectangular box-like frame constructed, preferably, of welded 2"×2" 16 gauge tubular steel including horizontal, upper front and rear beams 34, 35, and horizontal lower front and rear beams 36, 37, connected by a plurality of vertical front and rear connector beams 38, 39. To complete the box-like configuration, a plurality of upper and lower, horizontal connector beams 40, 41 extend between the front and rear faces F and R, respectively, of the device.

Each side section is formed by a substantially planar, horizontal frame section which, in effect, forms an extension of the lower portion of the center frame section. Thus, each side section includes lower front and rear beams 36′, 37′ respectively, connected by horizontal, front-to-rear connector beams 41′.

The center section also mounts an operator's chair, or seat, 42 on a seat post 43 which, in turn, is supported by a cross brace 44 which extends between upper front and rear beams 34, 35, respectively.

Also supported by the upper beams 34, 35 is a platform 45 which supports a motor M, as well as a conventional centrifugal clutch and transmission device (including forward, neutral and reverse gears) 46 provided with an operating shift lever 47. The motor M, which drives the unit, is preferably a 5 HP gasoline powered internal combustion engine.

Figure 6:
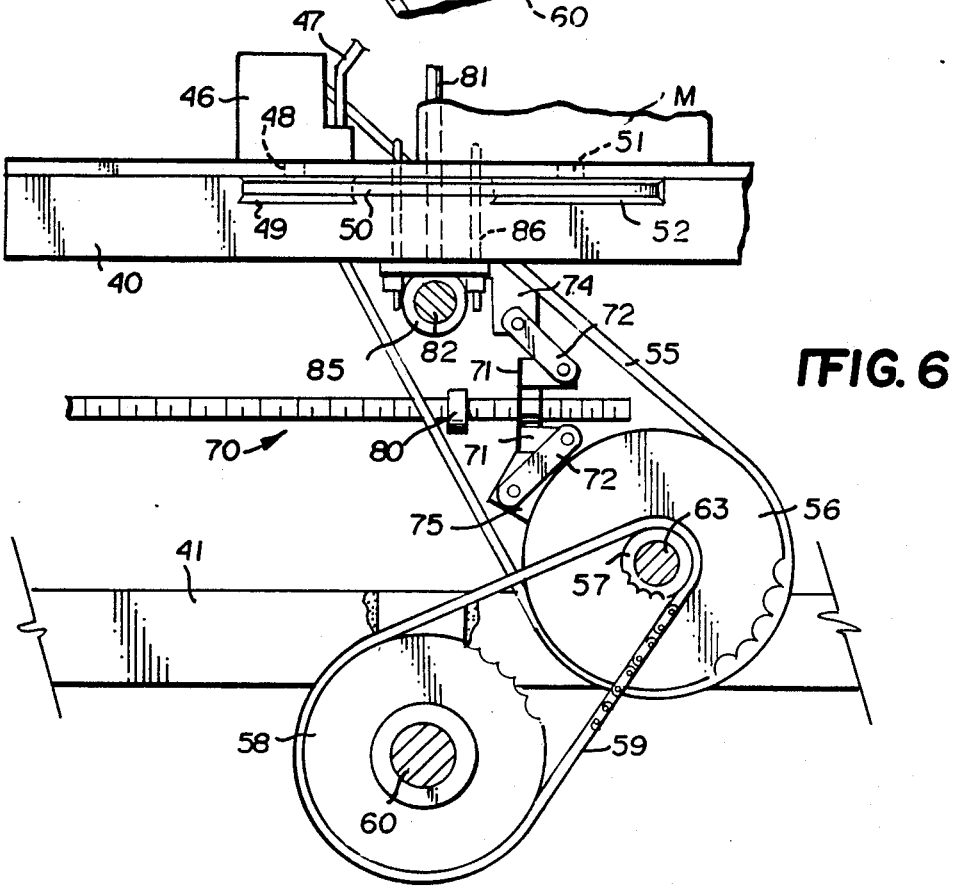
FIG. 6 is a partial side cross-sectional view taken along the line B—B of FIG. 2.

As best seen in FIGS. 2 and 6, the clutch mechanism includes an input shaft 48 to which a pulley 49 is attached. A drive belt 50 connects the clutch to the motor M by way of motor output shaft 51 and attached pulley 52. As can best be seen in FIG. 6, pulleys 49 and 52 are mounted for rotation about vertical axes, and are located just below the platform 45. The shift lever 47 extends upwardly from the clutch to a position adjacent and convenient to the operator from seat 42.

Figure 4:
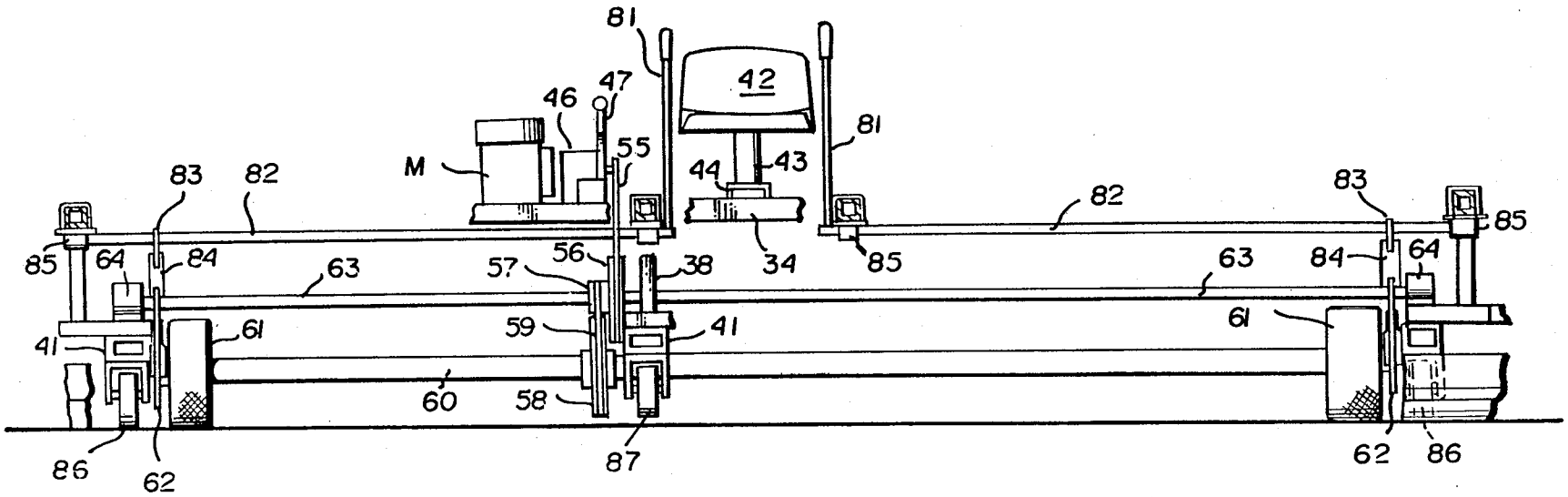
FIG. 4 is an enlarged front view of the center section view of the apparatus illustrated in FIG. 3, with parts removed to illustrate the drive train of the unit.
Figure 5:
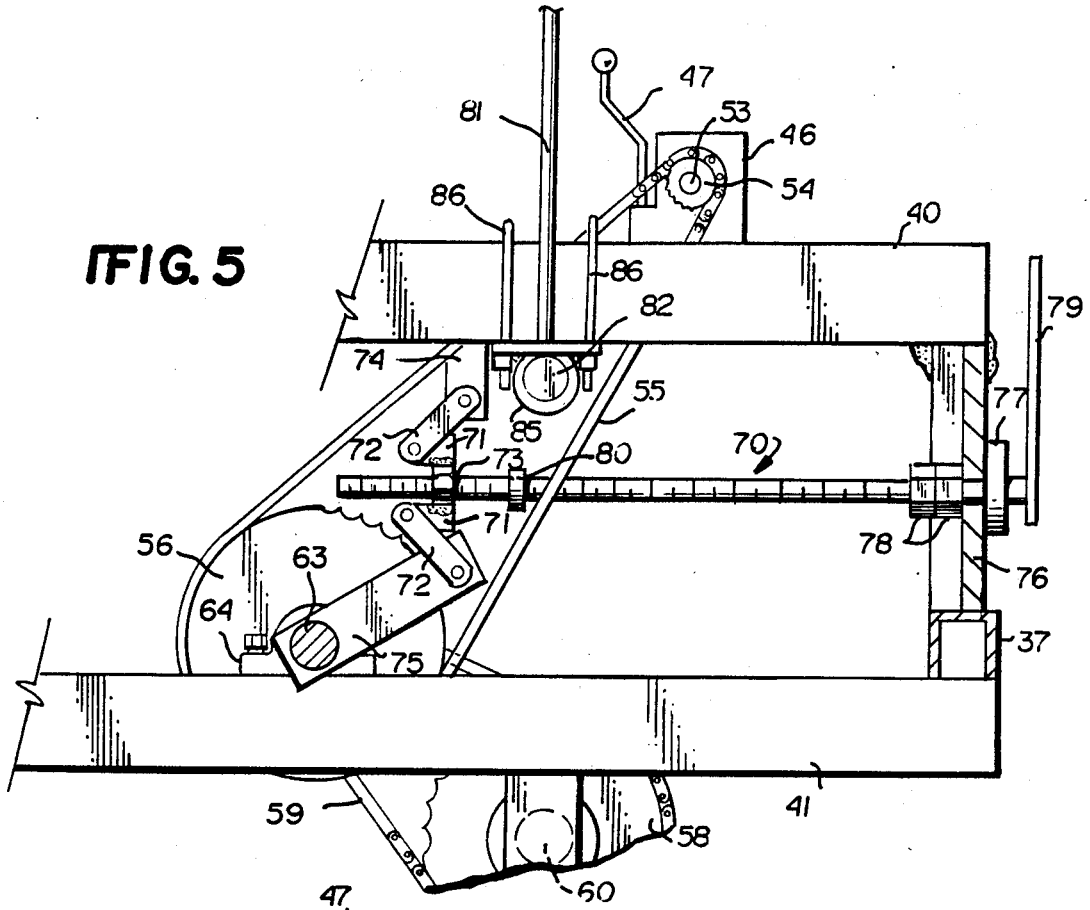
FIG. 5 is a partial side cross-sectional view taken along the line A—A of FIG. 2.

A horizontally oriented clutch output shaft 53, best seen in FIGS. 4, 5 and 6, mounts a sprocket 54 which is operatively connected by an endless chain 55 to an idler gear 56. The idler 56, and an associated smaller sprocket 57 are mounted on a shaft 63 for rotation relative to the shaft. Sprocket 57 is operatively connected to a final drive sprocket 58 via endless chain 59. Sprocket 58 is mounted for rotation on a live drive axle shaft 60, approximately midway along the length of the axle.

At either end of the live axle 60 there is mounted a drive wheel 61. The drive wheels are preferably 10.5 inches in diameter and are spaced approximately 18 feet apart, so that the wheels are located approximately 1 foot inwardly of the outer ends of the frame center section 31.

The above described drive train effects an overall 115:1 reduction between the motor output shaft and the drive axle.

With reference to FIGS. 2, 4, 7, 8, 11 and 12, the live axle 60 is supported at its ends by outboard bearings (not shown) associated with a pair of end plates 62, 62 which pivotally mount the drive axle 60 and drive wheels 61, 61 to the frame via a rotatable torsion shaft 63, which extends along substantially the length of the center section 31, substantially parallel to the drive axle 60. Shaft 63 is supported by a plurality of bearing blocks 64 mounted on the front-to-rear lower connector beams 41.

Shaft 63, which is preferably on the order of 1 inch in diameter, acts as a torsional spring which is rotatable about ±25° from a neutral position. The neutral position is defined as that in which drive wheels 61, 61 are in light contact with a flat ground surface. With particular reference to FIGS. 7 and 8, rotation of shaft 63 25° in a counterclockwise direction (as viewed in FIG. 7) from the neutral position, results in the drive wheels being lifted off the ground approximately 2½ inches, to an inoperative position illustrated in FIG. 8. Rotation of shaft 63 25° in a clockwise direction from the neutral position, results in a positive application of about 80% of the weight of the center section onto the drive wheels to enhance the traction of the unit.

Referring again to FIGS. 5 and 6, rotation of the torsional spring shaft 63 is accomplished by a manually operated screw jack 70 which actuates a toggle linkage 71, 72, via an attached thrust nut 73, operating between a fixed frame mount 74 and a crank 75 fixedly mounted for rotation with shaft 63, approximately midway along the length of the shaft. The screw jack 70 is also attached to a vertically oriented frame member 76 via a collar 77 and a pair of lock nuts 78. A handle 79 is provided to effect rotation of the screw jack causing the threaded thrust nut 73 to move axially therealong. An adjustable stop 80 is threadably mounted on the screw jack to limit movement of the thrust nut 73 toward the handle 79, and thus limit the extent of counterclockwise movement of the crank 75 (as viewed in FIG. 5). Depending on the direction of rotation of the screw jack, the toggle linkage 71, 72 will cause crank 75 to rotate shaft 63 in a clockwise or counterclockwise direction to raise or lower the drive wheels as previously described.

With reference now particularly to FIGS. 2 through 8, it may be seen that the device may be steered by the operator with the aid of a pair of steering levers 81, 81 extending substantially vertically on either side of the operator chair 42.

Each steering lever is connected to a respective steering shaft 82 which, in turn, is connected to an associated end plate 62 by a crank arm 83 fixed to the shaft and a push-pull rod 84, which may be in the form of an adjustable turnbuckle device.

When one of the steering levers 81, for example the lever 81 illustrated in FIG. 5 which corresponds to lever 81 to the left of the driver seat in FIG. 3 is pulled rearwardly, shaft 82 is caused to rotate in a clockwise direction (as viewed in FIG. 5) so that the associated crank arm 83 rotates in the same direction, causing end plate 62 to rotate in a counterclockwise direction about shaft 63 to thereby lift the drive wheel 61 off the ground. This drive wheel, to the left of the operator chair in FIG. 3, would normally be referred to as the right drive wheel, as viewed by the operator with the machine traveling in a forward direction. It will be appreciated that if this right drive wheel is raised off the ground, losing traction, the left drive wheel will pull the left side of the unit ahead of the right side, causing the unit to turn to the right. In other words, actuation of the left or right steering lever produces, in effect, a braking action on that side of the machine and a consequent turning toward the braked side.

The steering action produced by actuation of one or the other of the levers 81, 81 is made possible by the mechanical properties of the live axle shaft 60 and the torsion spring shaft 63. The drive axle 60 is designed with high torsional stiffness and low bending stiffness. The torsion spring shaft 63, on the other hand, is designed with low torsional stiffness. Thus, shaft 63 is able to absorb the torsional or twisting forces applied when the steering levers are actuated, with only minimal stress on the screw jack mechanism 70. At the same time, the lower bending stiffness of the live axle 60 permits one drive wheel to be lifted off the ground while the other wheel maintains its full tractional engagement.

The high torsional stiffness of the drive axle is desirable for reasons associated with the spreading of the coating material by the squeegee and brush arrangement described in detail hereinbelow.

Based on experiments, the frictional resistance of pushing the squeegee and brush arrangement of the lead applicator, and simultaneously pulling the brushes of the trailing applicator across a concrete surface, has a static value of about 600–650 lbs., and a dynamic value of about 400–450 lbs. Under normal conditions, this force is fairly evenly distributed along the approximate 58′ width of the unit, and the tractive requirement for each drive wheel 61 is approximately equal. However, when one side of the unit experiences more drag, the drive wheel on that side must apply an increased tractive force in order for the unit to maintain straight line movement. If the live drive axle 60 were not stiff in torsion, this increased torque demand would allow this wheel to be torsionally deflected behind the other wheel, causing the unit to stray off course. The torsionally stiff drive axle minimizes this tendency.

The entire unit, i.e., all three frame sections, is supported on a plurality of 360° swivel casters 86 which allow the unit to be pushed or pulled in any direction when the drive wheels 61 are in a disengaged, or inoperative position. It will be understood that two pair of casters 86 located at either end of the center section 31, as well as two pair of casters supporting each side section 32 and 33, remain in ground engaging contact at all times, with the exception explained further hereinbelow relating to the use of one or more transport dollies.

An additional pair of casters 87, 87 are mounted intermediate the ends of the center section 31, as best seen in FIG. 4. These casters are mounted adjacent the drive sprocket 58 and, under normal circumstances, do not touch the ground. In this regard, casters 86 preferably have a diameter of six inches, while casters 87 preferably have a diameter of five inches. The purpose of casters 87 is to prevent the drive sprocket 58, which has a ground clearance of about 1 inch, from dragging on high spots as the unit is transported, or is in operation over an uneven surface. In addition, if the weight of the center section 31 is carried only on the two pair of end casters 86, and the surface is relatively flat, then the weight of the center section is evenly distributed to each pair of the end casters. If, on the other hand, casters 87 were also a full six inches in diameter, and if they were to engage a high spot, casters 87 would then support most of the weight of the center section and cause unsightly and unacceptable grooves to be formed in soft asphalt court surfaces.

Along the front face F of the device, lower front beams 36 and 36′ of frame sections 31, 32 and 33 pivotally mount a respective channel member 90, 91 and 92. The channel members, like the frame sections, are in substantial axial alignment, so as to define substantially continuous surfaces from one end to the other.

A similar arrangement of channel members 90′, 91′ and 92′ are pivotally supported on beams 37, 37′ of the center and side frame sections, respectively, along the rear face F.

Since the manner in which the various channel members are supported from the various frame section beams is identical for all, only one will be described. As best seen in FIG. 9, channel member 90 is pivotally mounted to a plurality of outwardly extending pivot arms 93, via angle brackets 94 and pivot pins 95. Each arm 93 is, in turn, pivotally mounted between a pair of bracket plates 96 by a pivot pin, or bolt 97. The plates are welded to a common base plate 98 which attached to a lower front beam 36 by a pair of U-bolts 99. The arrangement is such that channel member 90 is freely floatable relative to the center frame section. Each of the remaining channel members 91, 92, 90', 91' and 92' are similarly mounted to respective frame sections along the front and rear faces of the device. While the mounting arrangement of the three channel sections along each of the front and rear of the unit is similar, the smoothing and spreading devices attached to the front or forward channel members which define the lead applicator, are arranged differently than those on the rear channel members which define the rear applicator as further described below.

Each of the axially aligned forward channels 90, 91 and 92, mount a dual configuration of resurfacing material spreading and smoothing devices including a leading squeegee-type flexible blade and a trailing bristle brush in a substantially continuous arrangement across the front face of the unit. Since each of the squeegee/-brush arrangements supported on the forward channels 90, 91 and 92 are identical, only the center section channel 90 will be described in detail. As best seen in FIG. 9, the channel member 90 includes a forward flange 110 and a trailing flange 111. The forward flange supports a flexible, squeegee-type blade 112, while the trailing flange supports a bristle brush 113. Fasteners 114, which may be bolts, screws, rivets or the like, are used to attach the blade and brush to the channel flanges.

The squeegee-type blade 112 is preferably a 0.025 inch thick, 60 Durometer Neoprene TM material, preferably about 4 inches in length, i.e., top to bottom. It will be understood, of course, that other suitable materials may be employed in the blade construction.

Brush 113 is preferably a polypropylene composition, with individual bristles being about 0.022 inches in diameter and about 4.50 inches in length. Here again, other suitable material may be used in forming the brush.

As stated earlier, the channel sections 90, 91 and 92 are in substantial axial alignment. Nevertheless, there is a relatively small gap between adjacent sections, as clearly seen in FIGS. 2 and 11. To foreclose the possibility of an irregular surface pattern being formed by reason of such a gap, a pair of gap seal devices 115 are employed at the juncture of the center channel 90 with side channels 91, 92, respectively. Each gap seal device, best seen in FIGS. 10 and 11, includes an angle bracket 116, a mounting arm 117 welded or otherwise attached to the bracket, and which is provided at one end with an axial slot 118. The angle bracket 116 supports, by bolts, rivets or other suitable fasteners 114, a squeegee-type blade 119 which overlaps adjacent blades 112 of adjacent channel members. The gap seal blade 119 is preferably about 0.062 inches thick and about 4.50 inches in length (top to bottom). This thinner, and slightly longer blade curls under the main blade sections 112 during resurfacing to assure a smooth, continuous surface during spreading of the acrylic or other resurfacing material. The gap seal devices 115 are mounted at either end of the center channel member 90 by means of suitable fasteners, such as wing nuts 120. The slots 118 permit adjustment of the gap seal devices relative to the channel and main blade.

With reference now to FIGS. 2 and 12, it may be seen that the rearward face R of the unit, channels 90', 91' and 92' mount identical brush elements (constituting the trailing applicator) and, as such, only the center channel section will be described in further detail. Rearward center channel member 90' is provided with a leading flange 121 and a trailing flange 122. Flange 121 supports a leading bristle brush 123 while flange 122 supports a trailing bristle brush 124. The brushes are fastened to the respective flanges by suitable fasteners 125 which may be bolts, rivets or the like.

As in the case of the forward channel members, gaps exist between rearward center channel 90' and respective side channel members 91' and 92'. Accordingly, a pair of gap brush devices 126 are provided, one of which is illustrated in FIG. 12. The gap brush device 126 is similar to the gap blade device 115 insofar as it includes an angle bracket 127 attached to a mounting arm 128 provided with an adjustment slot 129. The angle bracket supports a gap seal brush 130 similar to main brushes 123, 124. Unlike the blade gap devices, however, brushes 130 are not designed to curl underneath the main brush sections 123, 124.

In FIG. 13, an alternative gap brush device 131 is disclosed wherein a brush 132 is supported from an angle bracket 133. A pair of mounting arms 134 are pivotally mounted at first ends to channel bracket 135 via a pivot pin 136, which passes through a sleeve 136' welded or otherwise fixed to the angle bracket 133, and pivotally mounted at its second ends to the angle bracket 133 via pivot pin 137 which passes through a second sleeve 137' welded or otherwise fixed to the channel bracket 135. In this arrangement, the gap brush is able to float by reason of its double pivot connection relative to the channel member 90. Bracket 135 is also slidably adjustable along the channel to enable accurate placement of the brush.

With respect to the gap seal brushes, it has been found that they work best when the bristles are thinned at opposite side edges. In other words, and with reference to FIG. **13*b*, the brush 132 is tapered at 132'** on either side in directions transverse to the normal direction of movement of the brush, indicated by the arrow C.

With reference now to FIGS. 14 and 15, an optionally usable end brush device 138 is illustrated. The device includes an angle bracket 139, a bristle brush 140, a pair of mounting arms 141 and a channel bracket 142. The arms 141 are pivotally mounted at first ends to the channel bracket 142 via pivot pin 143, which passes through a sleeve 143' welded or otherwise fixed to the angle bracket 139, and at second ends to the angle bracket 139 via pivot pin 144 which passes through a sleeve 144' welded or otherwise fixed to the channel bracket 142. The double pivot arrangement allows the end brushes to float relative to their respective channel members in the same manner as the brush gap devices.

It will be understood that any other suitable means may be utilized to achieve the double pivot arrangement of both the gap seal brush shown in FIGS. **13, 13*a* as well as the end brush shown in FIGS. 14 and 15**.

It will be further understood that, normally, a pair of end brushes will be used, extending substantially perpendicularly outwardly from the forward face of the unit, and specifically from the ends of side channel members 91 and 92.

The end brushes are also adjustable along the length of the respective channel members according to the width of the area to be resurfaced, and are designed to keep the initially applied resurfacing material within the court boundaries. These are particularly advantageous in two-tone resurfacing where the "in-bounds" portion of the court is one color, and the "out of bounds" portion is another color. To further facilitate the confining action of the end brush devices, each is provided with a relatively stiff, curved foot 145, constructed, for example, of steel bar stock.

The manner in which the above described blades and brushes spread the resurfacing material across the surface will now be described. It is to be remembered initially in this regard that the forward and rearward channels 90,91, 92, 90′, 91′ and 92′ are free to float relative to the frame sections. In addition, the channel members are designed to provide good stiffness in the horizontal direction to counter the frictional resistance of the squeegee-type blades and brushes as they are pushed or pulled across the surface. At the same time, the channel members are designed to have less stiffness in the vertical direction, allowing them to "sag" along their respective lengths through any surface low spots, and to "hump" over surface high spots.

Thus, the floating action of the channels accommodates longitudinal undulations in the surface, while the low section modulus for bending allows the channels to accommodate transverse undulations.

It is also possible for the side sections 32, 33 to float to some extent relative to the center section 31 by reason of a pin and slot type hinged connection, illustrated most clearly in FIG. 11. Thus, pins 150 welded or otherwise secured to beams 36, 37 of the frame center section, are designed to fit within slots 151 provided in plate extensions 152 provided on the side section beams 36′, 37′. In this manner, frame side sections 32 and 33 are free to pivot in a vertical plane about a horizontal axis relative to the frame section 31. This arrangement also provides for easy separation of the side sections for transport and/or storage.

Figure 16:
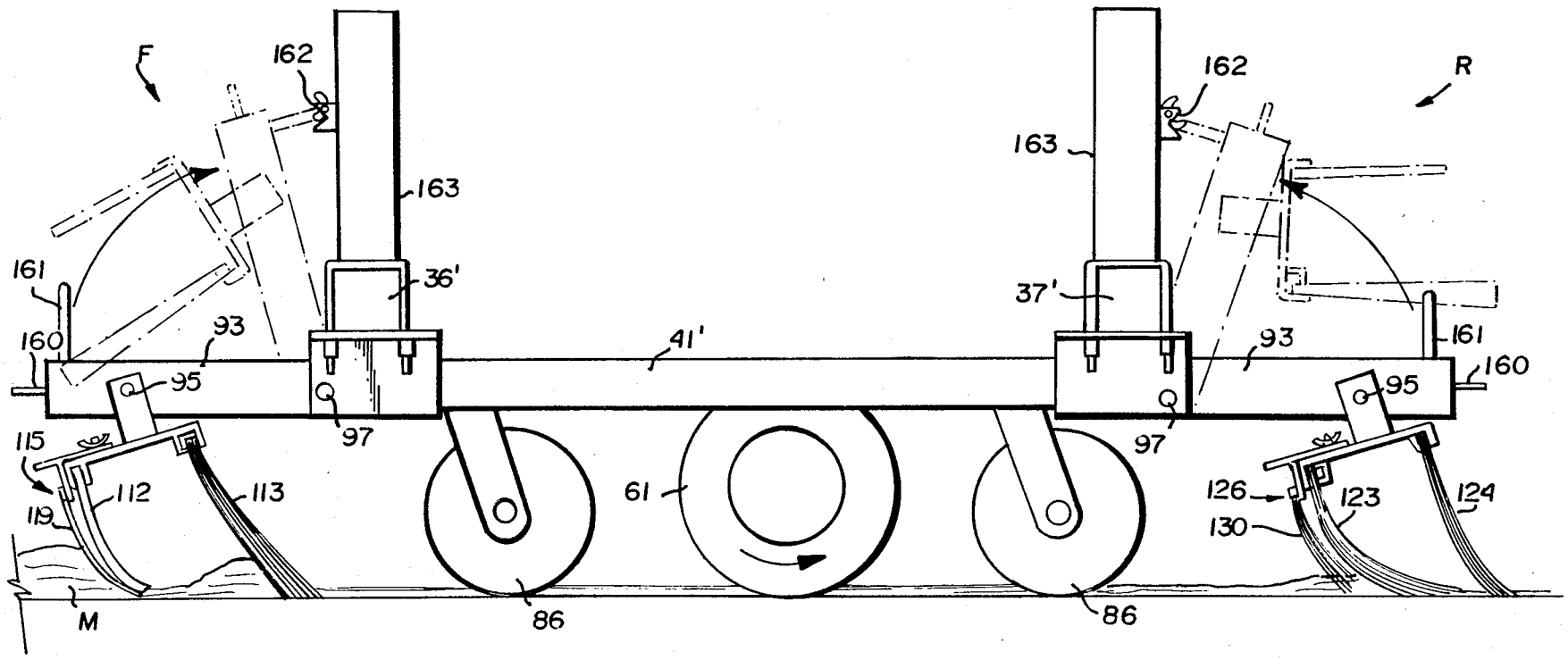
FIG. 16 is a partially schematic end of the apparatus in accordance with an exemplary embodiment of the invention.

With specific reference to FIG. 16, the lead applicator channels on the forward side F of the unit, including blades 112 (including gap seal devices 115) and brushes 113, are permitted limited rotation about pivot pins 95, 97 produced by the frictional force of the blades and brushes sliding along the surface. The rotation is stopped at a point where the lead applicator presents first the squeegee blades 112 and then the brushes 113 to the surface, with the weight of the applicator evenly distributed between the two.

The leading squeegee-type blade 112 pushes most of the resurfacing material M ahead of the unit, while allowing more than a sufficient quantity to flow underneath. The squeegee-type blades, of course, do not conform to individual surface irregularities, but, rather, bridge any small depressions, depositing acrylic material therein. The leading squeegee-type blades also contact the surface high spots and higher areas of the surface with higher interfacial pressure resulting in a thin coating in these areas. In this regard, the viscosity of the acrylic material M determines the average mil thickness of material which flows under the leading squeegee-type blades 112, including gap seal blades 119. Thus, it is important that the Durometer hardness of the squeegee and viscosity of the acrylic material be coordinated to achieve a desired coating thickness.

The trailing brushes 113 of the lead applicator follow about four inches behind the leading blades and produce a more uniform thickness and a preliminary brushed texture in the material.

To the rear of the unit, the rear applicator, including associated brushes 123 and 124 (and brush gap seal devices 126, is free to rotate about pivot pins 95, 97 to a position where substantially all of the weight of the applicator supported by the lead brush 123. This creates considerable bending deflection in the brush bristles of brushes 123 as well as gap seal brushes 130, with consequent higher interfacial contact pressure between the bristles and the surface.

This heavier bristle loading causes the rear applicator to brush the wetted surface to a thinner mil thickness than that left by the lead applicator. This also allows a small amount of acrylic material to build up ahead of the trailing brushes 123 which is used to cover up the drive wheel and caster tracks left in the wetted surface ahead of the rear applicator. This additional bristle deflection is also advantageous because, as the rear applicator passes over small depressions in the surface, the bristles are allowed to straighten to some extent to provide uniform contact, and thus remove the excess material deposited by the squeegee-type blades, thereby providing a very uniform mil thickness to even the smallest undulations in the surface.

The trailing brushes 124 of the rear applicator only lightly contact the wetted surface and are employed primarily to apply a finish texture to the surface.

In an alternative arrangement, the trailing brushes 113 of the lead applicator may be omitted, their function being performed by the brushes of the rear applicator.

FIG. 16 also illustrates a further feature of the invention related to the ability of the respective leading and trailing applicators to be pivoted upwardly to an inoperative position to facilitate transport and/or storage of the unit. To this end, handles 160 attached to the various channel members may be employed. In addition, closed loops 161 formed by U-bolts or the like, are also provided on the channel members for engaging latching devices 162 provided on the frame sections. One or more vertical posts 163 may be provided on the front and rear of the side frame sections for mounting the latching mechanism at the appropriate height while, in the center frame section, vertical posts 38 may be used. FIG. 16 illustrates in phantom, the leading and trailing applicators raised to an inoperative position.

Figure 17:
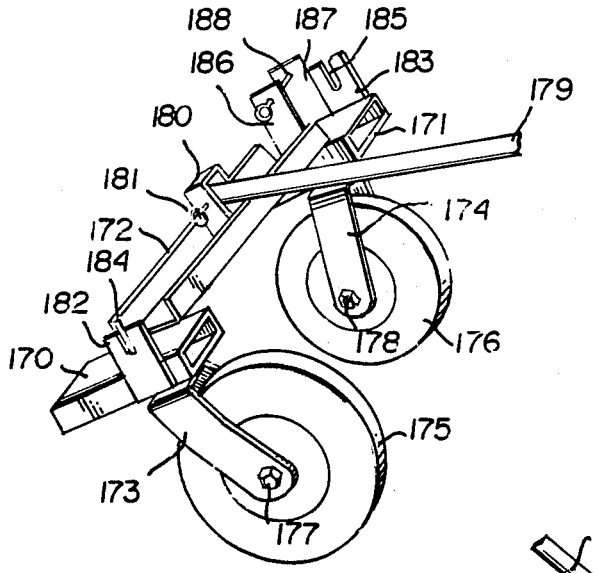
FIG. 17 is a perspective view of a transport dolly designed particularly for use with the subject invention.
Figure 18:
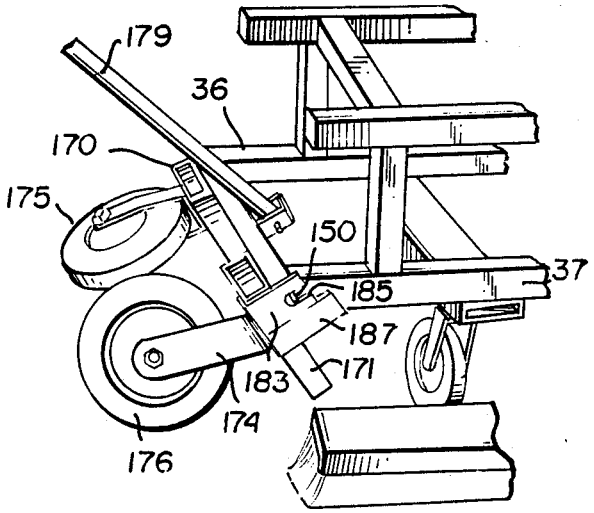
FIG. 18 is a perspective view of the transport dolly of FIG. 17 in position to be pivoted into operative association position relative to the frame center section.
Figure 19:
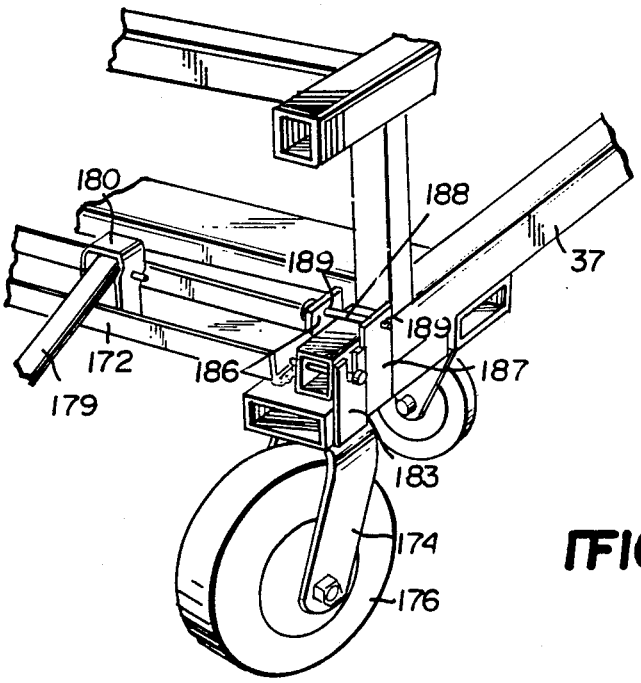
FIG. 19 is a perspective view of the transport dolly of FIG. 17 in operative position, supporting the frame center section.

With reference now to FIGS. 17 through 19, a transport dolly is illustrated for facilitating transport of the frame center section 31.

The transport dolly is formed by a pair of box beam sections 170, 171 connected by a cross beam 172. The box beams 170, 171, in turn, mount a pair of freely rotatable wheel mounting forks 173, 174, respectively. Fork 173 mounts a tire 175, preferably of the pneumatic variety, for rotation about an axle or bolt 177. Similarly, fork 174 mounts a tire 176 for rotation about an axle or bolt 178. An elongated handle 179 is pivotally mounted to the cross beam 172 via an inverted U-shaped bracket 180 and associated cotter-type pin 181.

A pair of upstanding, pin-engaging plates 182, 183 are fixed, by welding or other suitable means to the respective outer side surfaces of the box beams 170, 171. The plates are provided with open-ended slots 184, 185, respectively, extending downwardly from the tops of the plates.

In addition, at least one of the box beam sections 170, 171 is also provided with a pair of upstanding ears 186, 187, one of which may be formed as an extension of plate 183.

In use, the flat upper surfaces of box beam sections 170, 171 are adapted to engage and support the lower surfaces of beams 36, 37, respectively, while slots 184, 185 receive pins 150, 150 which are fixed to the ends of the beams 36, 37 of the frame center section. These pins, as will be recalled, normally serve as connection means for the side or wing sections. However, during transport in and out of an enclosed court area, for example, the side sections may be separated from the center section, which, of course, is the heaviest by reason of its carrying the motor, drive train, steering mechanism, etc.

Accordingly, the transport dolly is designed particularly as an aid to moving the frame center section.

With reference now to FIG. 18, the dolly is tilted to an inclined position relative to the frame center section so that slots 184, 185 may engage pins 150, 150. Once the pins are seated within the slots, handle 179 may be used as a lever to pivot the dolly in a counterclockwise direction, until box beams 170, 171 fully engage beams 36, 37. In this position, the end of the frame center section, including casters 86, are lifted approximately four inches off the ground. Subsequently, a pin 188 is inserted through aligned apertures 189 in the upstanding ears 186, 187, just above the top surface of the beam 37 so as to prevent the dolly from dropping down into the position illustrated in FIG. 18.

With the transport dolly in place, handle 179 may be used to pull the frame center section with relative ease, due in large part to the relatively large pneumatic tires 175, 176.

It will be appreciated that if desired, a second dolly may be employed at the other end of the frame center section, although usually not required. Thus, the use of transport dollies is designed to facilitate movement to and from a court area, loading and off-loading vis-a-vis a truck bed, etc. while casters 86 are sufficient to move the apparatus about a court, and to or from adjacent courts during a resurfacing operation.

Referring back now to FIG. 1, the operation of the machine will be described in connection with a resurfacing operation for two adjacent tennis courts. This is merely exemplary of the many court or surface configurations which can be resurfaced with the unit disclosed herein. Initially, the machine 30 is placed beyond the boundary 6 of the court for movement lengthwise of the court as indicated by arrows A. Prior to machine actuation, a mass of resurfacing material M in an amount sufficient to resurface the entire court 2, is applied ahead of the machine in a manner as generally indicated in FIG. 1. Alternatively, a plurality of rows, or windows of the resurfacing of the resurfacing material may be deposited in front of, and parallel to, the machine with additional windows added as needed. The first mentioned, and preferred pattern provides good spreading characteristics and minimizes the tendency of the material to flow around the side sections of the machine. In either case, it has also been found to be advantageous to spread a relatively small quantity of resurfacing material along the leading brushes of the trailing applicator to "prime" the brushes upon start up.

After application of the resurfacing material, the machine drive is actuated to cause the machine to traverse the entire length of court until it reaches a position indicated in phantom by the reference numeral 190. During this path of travel, it will be understood that the flexible squeegee-type blades and brushes of the leading applicator spread and smooth out the windows W of resurfacing material as described above, while, at the same time, the flexible brushes of the trailing applicator smooth out and eliminate tracks and other surface irregularities caused by movement of the casters and drive wheels through the resurfacing material. The final average overall thickness of the material applied to the surface is from about 12 to about 15 mil.

Once the machine has reached the position indicated by reference numeral 190, the drive wheels are raised and the unit is swung around on its casters so that the forward face F is facing the second court 3 to be resurfaced. Upon reengagement of the drive wheels, the machine is ready to traverse a path indicated by arrows B. Prior to actuation, another mass of resurfacing material would, of course, be applied to the surface of court 3, in front of the machine as described above.

Figure 1A:
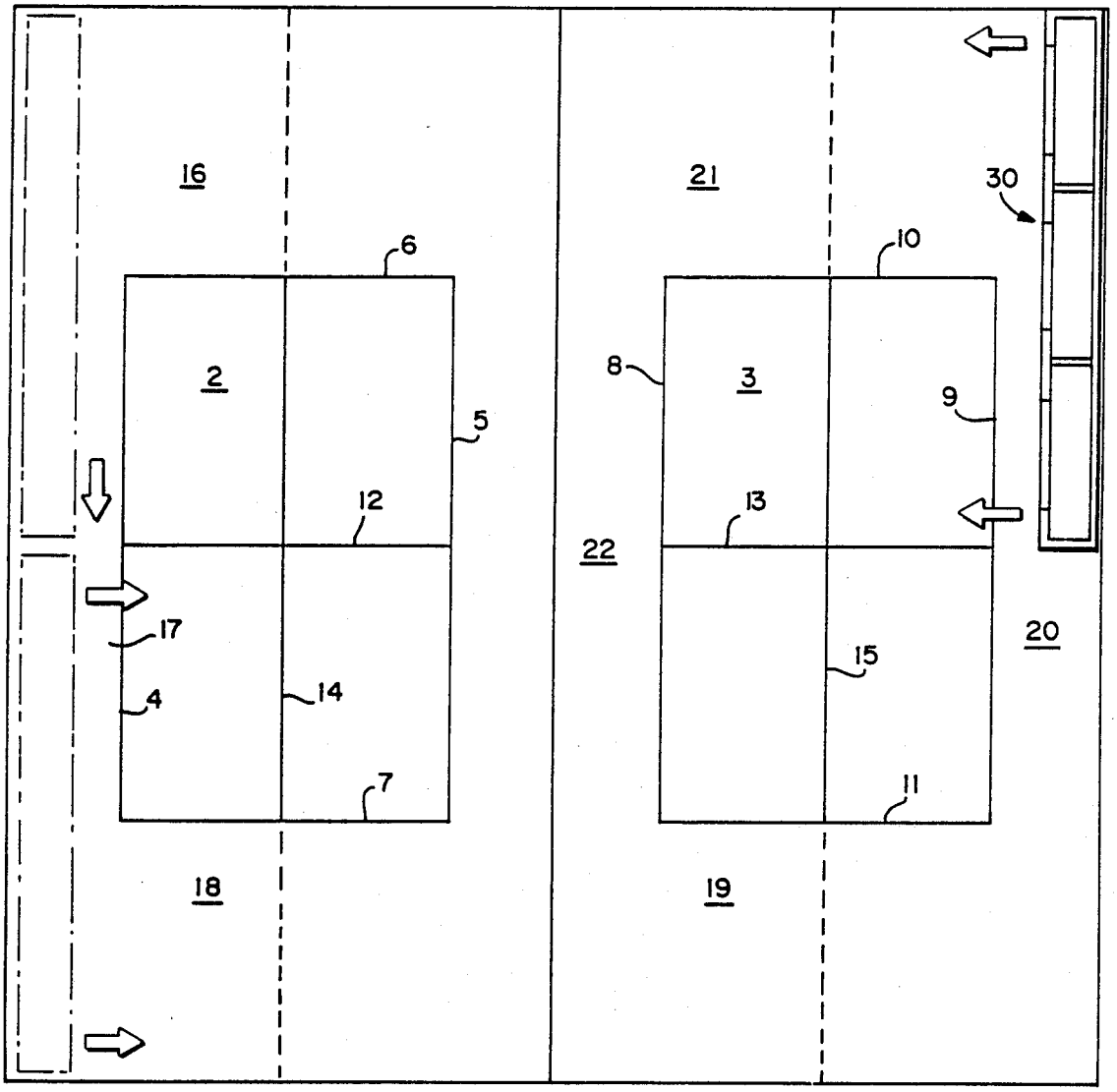
FIG. 1*a* is a schematic view of the resurfacing device shown in FIG. 1, positioned to resurface a pair of adjacent tennis courts in accordance with an alternative resurfacing procedure.

In an alternative procedure, the unit may be arranged to move across the width of one or more aligned courts, such that half of one or more adjacent courts are resurfaced in one pass, while the other half of the one or more courts are resurfaced in a return pass. This alternative procedure is illustrated in FIG. 1A, with movement of the machine indicated by phantom lines and by arrows.

It will also be appreciated that more than one coat may be applied, as desired. In addition, where two coats are applied, application of such coats in perpendicular directions has been found to create a particularly attractive, "linen-like", or criss-cross texture to the court surface, created by the unique arrangement of brushes on the trailing applicator.

In carrying out the above described process, it is an added feature of this invention that existing painted boundary lines, service lines, etc. on the one or more courts to be resurfaced are covered with, for example, a light adhesive tape, which is removed subsequent to the application of the resurfacing material, and will not take up the paint during its removal. If the boundary lines are in need of re-painting, it is preferable that this be done prior to taping so that when the tape is subsequently removed, the process is completed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A method of resurfacing a surface generally defined by length and width boundaries comprising the steps of:

(a) providing a self-propelled resurfacing device including at least a pair of drive wheels, said device having front and rear faces and a width spanning at least one of the boundaries of said surface, said drive wheels being located intermediate said front and rear faces, and said device further provided with free floating, spreading and smoothing means mounted along each of said front and rear faces, wherein said spreading and smoothing means comprises elongated, flexible squeegee means mounted along said front face and elongated flexible brush means mounted along said rear face;

(b) aligning said device outside and substantially parallel to said at least one boundary;

(c) deposing a mass of resurfacing material to said surface at least between said device and said at least one outer boundary; and (d) moving said device across said surface in a direction substantially transverse to said at least one outer boundary so that said spreading and smoothing means spreads and smooths said resurfacing material across at least the entire surface, said flexible brush means being subjected to bending deflection sufficient to provide a uniform coating on said surface including depressions and surface irregularities therein, and wherein said elongated flexible brush means, means erases tracks in said resurfacing material caused by said drive wheels.

2. A method as defined in claim 1, wherein said resurfacing material is an acrylic composition.

3. A method as defined in claim 1, and wherein step (d) includes applying additional resurfacing material, as necessary, as said device is moved across said court.

4. A method of resurfacing a regulation tennis court comprising the steps of:

(a) applying removable strips over existing court boundary lines;

(b) applying a mass of resurfacing material along, and outside of, at least one outer boundary of said court;

(c) spreading and smoothing said material to a uniform thickness with a resurfacing device by moving the device across said court once in a single pass and direction to form a first coating on said court; and (d) after said tennis court is resurfaced, removing said strips of material from said boundary lines.

5. A method as defined in claim 4, wherein step (c) is repeated prior to step (d) to form a second coating on said surface.

6. A method as defined in claim 5 wherein said second coating is applied in a direction substantially perpendicular to said first coating to create a criss-cross texture in said resurfacing material.

7. A method of resurfacing a regulation tennis court as defined in claim 4 wherein prior to step (a), said boundary lines are painted.

8. Resurfacing apparatus comprising:

frame means;

a plurality of freely rotatable, non-driven wheel means mounted on the underside of said frame means;

self-contained, selectively engageable drive means for effecting driven movement of said frame means, said drive means including drive wheels and means for moving said drive wheels between a ground disengaged transport position, a neutral ground engaging position, and a positive traction resurfacing position;

free floating flexible blade means mounted on, and extending along a front face of said frame, and free floating brush means mounted on, and extending along a rear face of said frame, said flexible blade and brush means adapted to engage a mass of resurfacing material applied to a surface and to spread and smooth said material as said frame means traverses said surface.

9. Apparatus as defined in claim 8, wherein free floating flexible brush means are also mounted to said frame across the front face thereof, but behind said flexible blade means.

10. Apparatus as defined in claim 8, wherein said flexible blade means are constructed of a rubber composition, and wherein said brush means are constructed of polypropylene.

11. Apparatus as defined in claim 8, wherein said frame means comprise a center section and two separable side sections, each section having a length of about 20 feet, and wherein each of said sections is provided with supporting wheel means, and wherein only the center section is provided with said drive means.

12. Apparatus as defined in claim 8, wherein said drive means comprise a pair of drive wheels rotatably mounted on a live axle pivotally mounted relative to said frame.

13. Apparatus as defined in claim 12 and including means for moving said drive wheels between said disengaged position wherein said drive wheels are out of contact with the ground; said neutral position wherein said drive wheels lightly engage the ground; and said traction position wherein said drive wheels are biased into positive ground engaging contact.

14. Apparatus as defined in claim 12, wherein said drive wheels have means associated therewith for steering said apparatus, said steering means being operative to lift one or the other of said drive wheels out of contact with the ground.

15. Apparatus as defined in claim 11 wherein dolly means are provided for releasable attachment to at least one end of said center section.

16. Resurfacing apparatus for uniformly spreading material across a surface comprising:

a frame including a front face and a rear face;

a leading free floating material applicator extending from said front face and including leading squeegee-type blade means and trailing brush means;

a trailing free floating material applicator extending from said rear face and including at least leading brush means, wherein said leading and trailing applicators are mounted for free floating pivotal motion relative to said frame.

17. Apparatus according to claim 16 wherein said trailing applicator further includes trailing brush means.

18. Apparatus according to claim 16 wherein said frame includes self-contained drive means including a pair of drive wheels, said trailing applicator being adapted to erase tracks in said material caused by said drive wheels.

19. Apparatus according to claim 16 wherein a pair of end brush devices are provided, said brushes attached to said leading applicator at outer ends of said frame side sections and extending forward of said leading applicator in a direction substantially perpendicular to said leading squeegee-type blade means.

20. Apparatus according to claim 18 wherein said drive means further includes a motor operatively connected to a live axle supporting said drive wheels through a clutch, transmission and chain drive gear train.

21. Apparatus as defined in claim 20 wherein said device further includes means for raising said live axle such that said drive wheels are out of contact with the ground.

22. Apparatus as defined in claim 21 wherein said means for raising said live axle comprise:

a screw jack mounted to said frame;

thrust means threadably received on said screw jack;

a toggle linkage connected between said thrust means and a crank arm;

a torsion shaft extending substantially parallel to said live axle and supported at its ends by bearings mounted on said frame;

a pair of arms, each of which extends between an end of said torsion shaft and said live axle such that said live axle is supported for pivotal motion about said torsion shaft;

and wherein said torsion shaft mounts said crank arm intermediate its ends so that upon rotation of said screw jack, said live axle will be raised or lowered depending on the direction of rotation of said screw jack.

23. Apparatus as defined in claim 21 wherein said device includes means for steering said device, said steering, means, including means for selectively lifting one or the other of said drive wheels out of contact with the ground.

24. Apparatus as defined in claim 22 wherein said device includes means for steering said device, said steering means including means for selectively lifting one to the other of said drive wheels out of contact with the ground.

25. Apparatus as defined in claim 24 wherein said torsion shaft absorbs torque applied by said steering means.

26. Apparatus as defined in claim 22 wherein said torsion shaft may be rotated about ±25° from a neutral position wherein said drive wheels are in lightly engaging contact with the ground, and wherein rotation of said shaft about 25° in one direction from said neutral position raises said drive wheels off the ground, and rotation of the shaft about 25° in an opposite direction from said neutral position causes said drive wheels to be biased into positive ground engaging contact.

27. Resurfacing apparatus comprising:

a frame;

freely floatable spreading and smoothing means pivotally mounted on front and rear faces of said frame;

drive means mounted on said frame;

drive wheels operatively connected to said drive means and mounted on said frame for movement between operative and inoperative positions; and steering means mounted on said frame for selectively lifting one or the other of said drive wheels off the surface.

28. A method of resurfacing a pair of adjacent regulation tennis courts having prescribed length and width dimensions, the length dimension bifurcated by a net line, comprising the steps of:

(a) providing a resurfacing device including a frame having front and rear faces, each face provided with flexible spreading and smoothing means, said frame having a width which exceeds one half the length dimension of the courts;

(b) aligning the resurfacing device outside one of said courts, and substantially parallel to a lengthwise boundary line of one of said courts, such that one end of the device is located approximately at the net line of one of the courts, and extends beyond first end lines of said courts;

(c) applying a mass of resurfacing material in front of the front face of the resurfacing device;

(d) moving the resurfacing device across the adjacent pair of tennis courts in a first direction substantially transverse to the length dimension so that the spreading and smoothing means spreads and smooths the resurfacing material across at least one half of the pair of adjacent tennis courts in a first pass;

(e) realigning the device outside the other of said courts, and substantially parallel to a lengthwise boundary line of the other of said courts, such that one end of the device is located approximately at the net line of the other of the courts and extends at least beyond second end lines of said courts opposite said first end lines;

(f) applying a mass of resurfacing material in front of the front face of the resurfacing device; and (g) moving the device across the adjacent pair of tennis courts in a second direction opposite said first direction substantially transverse to the length dimension so that the spreading and smoothing means spreads and smooths the resurfacing material across at least the other half of the pair of adjacent tennis courts in a second pass.

29. Resurfacing apparatus for uniformly spreading material across a surface comprising:

a frame including a front face and a rear face;

a leading material applicator extending from said front face and including leading squeegee-type blade means and trailing brush means;

a trailing material applicator extending from said rear face and including at least leading brush means;

said leading and trailing applicators mounted for free floating pivotal motion relative to said frame; wherein said frame and said leading and trailing applicators are constructed in three separable, and substantially axially aligned sections, including a center section and two side sections; and wherein said leading and trailing applicators are provided with additional squeegee means and brush means, respectively, for sealing gaps between the axially aligned center and side frame sections.

30. Apparatus according to claim 29 wherein each of said side sections is movable relative to said center section about a horizontal axis extending from front to rear of said frame.

31. Apparatus according to claim 30 wherein dolly means are provided for releasable attachment to at least one end of said center section.

* * * * *